US005839283A

United States Patent [19]

Döbbeling

[11] Patent Number: 5,839,283

[45] Date of Patent: Nov. 24, 1998

[54] MIXING DUCTS FOR A GAS-TURBINE ANNULAR COMBUSTION CHAMBER

[75] Inventor: Klaus Döbbeling, Windisch, Switzerland

[73] Assignee: ABB Research Ltd., Zurich, Switzerland

[21] Appl. No.: 751,721

[22] Filed: Nov. 18, 1996

[30] Foreign Application Priority Data

Dec. 29, 1995 [DE] Germany ..... 195 49 143.2

[51] Int. Cl.[6] ..... F23R 3/12; F02C 3/00

[52] U.S. Cl. ..... 60/737; 60/747; 60/751; 60/39.06

[58] Field of Search ..... 60/737, 738, 746, 60/748, 751, 747, 39.06, 39.37

[56] References Cited

U.S. PATENT DOCUMENTS

| | | | |
|---|---|---|---|
| 2,627,721 | 2/1953 | Rosenlund | 60/751 |
| 3,299,632 | 1/1967 | Wilde et al. | 60/751 |
| 4,455,840 | 6/1984 | Matt et al. | 60/737 |
| 4,991,398 | 2/1991 | Clark et al. | 60/748 |
| 5,207,064 | 5/1993 | Ciokajlo et al. | 60/737 |
| 5,400,587 | 3/1995 | Keller et al. | 60/748 |
| 5,557,918 | 9/1996 | Chyou et al. | 60/751 |
| 5,573,395 | 11/1996 | Althaus et al. | 431/278 |
| 5,588,826 | 12/1996 | Dobbeling et al. | 431/354 |
| 5,592,820 | 1/1997 | Alary et al. | 60/751 |
| 5,619,855 | 4/1997 | Burrus | 60/751 |

*Primary Examiner*—Timothy Thorpe
*Assistant Examiner*—Ted Kim
*Attorney, Agent, or Firm*—Burns, Doane, Swecker & Mathis, L. L. P.

[57] ABSTRACT

In a gas-turbine annular combustion chamber (4) which is arranged downstream of a compressor (1) and is equipped on its front plate with at least one row of premix burners (5) arranged in an annular form, in each case a combustion-air duct (15) designed as a diffuser leads directly downstream of the compressor outlet from the guide vanes (9) of the last compressor row to each burner (5), at the downstream end of which combustion-air duct (15) at least one longitudinal-vortex generator (16) is located, at least one fuel injection means (17) being provided in or downstream of the longitudinal-vortex generator (16). A mixing duct (19) which ends in the combustion chamber (4) and has a constant height (H) and a length (L) which corresponds approximately to twice the value of the hydraulic duct diameter (D) is arranged downstream of the fuel injection means (17). The overall size of the gas turbine in the region of the combustion chamber (4) can thereby be substantially reduced. In addition, the pressure loss between compressor outlet and turbine inlet is reduced.

15 Claims, 4 Drawing Sheets

MIXING DUCTS FOR A GAS-TURBINE ANNULAR COMBUSTION CHAMBER

BACKGROUND OF THE INVENTION

1. Field of the Invention

The invention relates to the field of combustion technology. More particularly, the invention relates to a gas-turbine annular combustion chamber which is operated with premix burners as well as to a method of operating this device.

2. Discussion of Background

Gas turbines essentially comprise the components compressor, combustion chamber and turbine. For reasons of environmental protection, work is increasingly being carried out with low-pollution premix combustion instead of diffusion combustion.

It is known in the prior art (cf. H. Neuhoff and K. Thoren: "Die neuen Gasturbinen GT 24 and GT 26-hohe Wirkungsgrade dank sequentieller Verbrennung", The New GT24 and GT26 Gasturbines-High Efficiency through Sequential Combustion ABB Technik 2(1994), pages 4–7 and D. Viereck: "Die Gas-turbine GT13E2—ein richtungsweisendes Konzept fur die Zukunft", The GT13E2Gasturbine-a Guiding Concept for the Future ABB Technik 6(1993), pages 11–16) to arrange a plenum between the compressor and the annular combustion chamber, equipped with a plurality of premix burners, of a gas turbine, in which plenum very low air velocities prevail. The plenum is intended to equally distribute the air over the burners. In addition, a means of extracting cooling air for the combustion chamber and the turbine at a high pressure level is thus provided.

The air issuing from the compressor has a very high velocity (about 200 m/s) and, in order to recover the kinetic energy contained in it, is decelerated in a deflection diffuser as far as possible without losses.

In order to obtain low-pollution combustion, fuel and combustion air are premixed in the burner. For the purpose of carrying out the premix operation in an operationally reliable manner, however, the velocity must be very high at the intermixing point, in the vicinity of which a zone having a stoichiometric mixture is located, so that flashback of the flame can be reliably avoided. The air, which in the plenum has only very low velocities (about 10 m/s), must therefore be accelerated again to high velocities (about 80 to 100 m/s) in the premix zone.

In order to stabilize the flame downstream of the premix burner at a fixed location, the velocity in the combustion chamber is. greatly reduced again at least locally downstream of the burner. A local recirculation zone having negative velocities is usually produced. In the combustion chamber, the velocity is then about 50 m/s in order to obtain an adequate residence time and to keep down the heat transfer between hot gas and combustion-chamber wall. At the outlet of the combustion chamber, acceleration is again effected so that velocities of the gas approaching the velocity of sound are achieved at the inlet of the turbine.

The repeated accelerations and decelerations of the flowing media (air, fuel/air mixture, hot gases) between compressor outlet and turbine inlet have the disadvantage that they involve losses in each case. In addition, they require repeated deflections of the entire air mass flow, since the distance between compressor outlet and turbine inlet has to be kept small for rotordynamic reasons, so that the overall size of the combustion chamber according to the prior art is quite large and complicated.

SUMMARY OF THE INVENTION

Accordingly, one object of the invention, in attempting to avoid all these disadvantages, is to develop a novel gas-turbine annular combustion chamber which is equipped with special premix burners, is distinguished by a small overall size and is simplified compared with the known prior art, improved premixing of fuel and air being effected with a smaller total pressure loss.

According to the invention, this is achieved in that, in a gas-turbine annular combustion chamber which is arranged downstream of a compressor and is equipped on its front plate with at least one premix-burner row arranged in an annular form, in each case a combustion-air duct designed as a diffuser leads directly downstream of the compressor outlet from the guide vanes of the last compressor row to each burner, at the downstream end of which combustion-air duct at least one longitudinal-vortex generator is located, at least one fuel injection means being provided in or downstream of the longitudinal-vortex generator, and a mixing duct which ends in the combustion chamber and has a constant duct height and a length which corresponds approximately to twice the value of the hydraulic duct height being arranged downstream of the fuel injection means.

The combustion air, directly after discharge from the compressor, is split up into individual air flows for the burners and for the cooling of the combustion chamber and the turbine, the velocity of the air for the burners is then decelerated to approximately half the value of the compressor outlet velocity, and at least one longitudinal vortex is then generated in the air per combustion-air duct, fuel being admixed during or downstream of the longitudinal-vortex generation, the mixture at this point flowing along in a mixing duct and flowing with an overall swirl imposed on it into the combustion chamber and finally being burnt there.

The advantages of the invention consist, inter alia, in the fact that the combustion chamber has smaller dimensions compared with the prior art and the area to be cooled in the combustion chamber is reduced. The pressure loss between compressor outlet and turbine inlet is smaller. In addition, the air is equally distributed over the burners in a very effective and stable manner and the premixing of fuel and combustion air is improved.

It is especially expedient if the the ratio of the number of blades of the last compressor row to the number of premix burners is integral, in particular 1 or 2, since a combustion-air duct can then be coupled directly to one or two blade ducts of the last compressor row.

It is of advantage if the mixing duct has an approximately round cross section, since good intermixing of air and fuel is than achieved. But mixing ducts having a rectangular cross section are also conceivable. Likewise, if only one burner row is present, the mixing duct may be designed as a segmented annular gap.

Furthermore, it is advantageous if the combustion-air ducts are arranged spirally around the axis of the gas turbine. Axial length can be saved in this way.

Finally, the axes of the mixing ducts (i.e. the direction of flow of the mixture entering the combustion chamber) are advantageously arranged in such a way that they form an angle, preferably an angle of 45°, with the axis of the gas turbine. The mixing and flame stabilization are thereby further improved.

Furthermore, if there is more than one annular premix-burner row, it is expedient if the burners are set in an opposed manner from row to row in the peripheral direction. The overall swirl in the combustion chamber consequently becomes zero.

In addition, it is of advantage if air is additionally injected into the boundary layer of the mixing duct, since flashback of the flame into the mixing zone is thereby further prevented.

It is advantageous if, when fuel having an average calorific value (MBtu) is used, this fuel is intermixed in a region of high air velocity (>100 m/s). Flashback to the fuel injector is thereby reliably avoided even in the case of these fuels, which have a very high flame velocity.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for understanding the invention are shown. Elements of the plant which are not shown &re, for example, the exhaust-gas casing of the gas turbine with exhaust-gas tube and flue as well as the inlet portions of the compressor part and the low-pressure compressor stages. The direction of flow of the working media is designated by arrows.

DETAILED DESCRIPTION OF THE PREFERRED EMBODIMENTS

Figure 1:
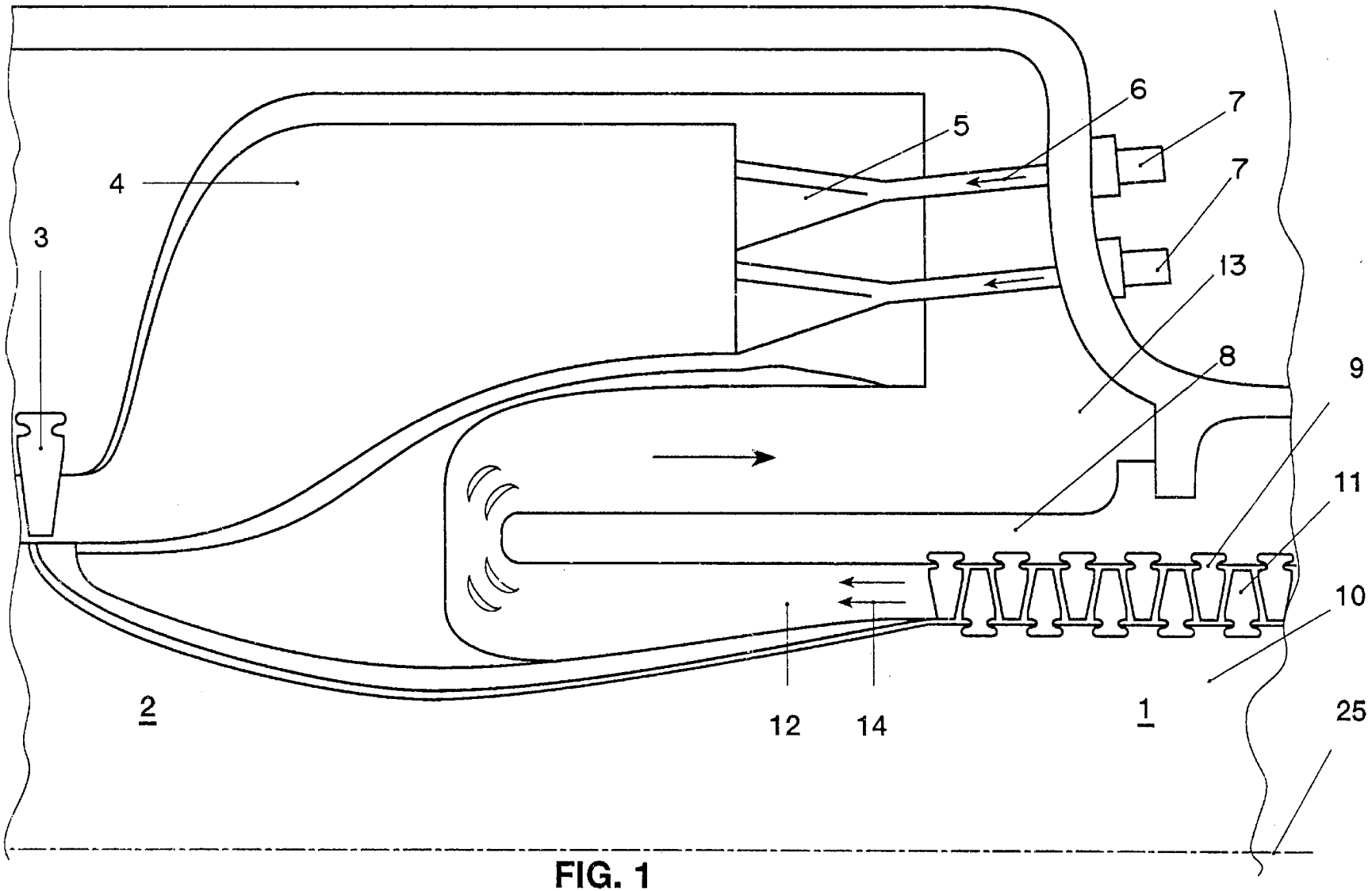
FIG. 1 shows a partial longitudinal section of a gas-turbine plant having an annular combustion chamber according to the prior art equipped with premix burners.

Referring now to the drawings, wherein like reference numerals designate identical or corresponding parts throughout the several views, FIG. 1 shows first of all a partial longitudinal section of a gas-turbine plant having an annular combustion chamber according to the prior art. An annular combustion chamber 4, which is equipped with premix burners 5 of the double-cone type of construction, is arranged between a compressor 1 and a turbine 2, of which only one guide vane 3 of the first guide-vane row is shown. The feeding of the fuel 6 to each premix burner 5 is realized via fuel lances 7. The annular combustion chamber 4 is cooled convectively or by means of impact cooling. The compressor 1 essentially comprises the blade carrier 8, in which the guide vanes 9 are suspended, and the rotor 10, which accommodates the moving blades 11. In FIG. 1, in each case only the last compressor stages are shown. A deflection diffuser 12 is arranged at the outlet of the compressor 1. It leads into a plenum 13 arranged between compressor 1 and annular combustion chamber 4.

The air 14 issuing from the compressor 1 has a very high velocity. It is decelerated in the deflection diffuser 12 in order to recover the kinetic energy contained in it, so that only very low air velocities prevail in the plenum 13 adjoining the deflection diffuser 12. The air 14 can thereby be equally distributed over the burners 5 and cooling air for the combustion chamber 4 and the turbine 2 can be extracted without problem. On the other hand, however, since the velocity must be high to avoid flashback of the flame in order to carry out the premix operation of air 14 and fuel 6 at the intermixing point of the fuel 6 in an operationally reliable manner, the air 14 has to be greatly accelerated again in the premix zone before a reduction in the velocity is again effected downstream of the burners 5 in the combustion chamber 4 for reasons of flame stability. At the downstream end of the combustion chamber 4, the gas is again accelerated so that velocities close to the velocity of sound are reached at the inlet to the turbine 2. The repeated accelerations and decelerations between compressor outlet and turbine inlet involves losses and the requisite repeated deflections of the air mass flow lead to quite a large overall height. Thus, for example, in a gas turbine of the 170 MWel class according to the prior art (see FIG. 1), the outside diameter in the region of the combustion chamber is about 4.5 m.

Figure 2:
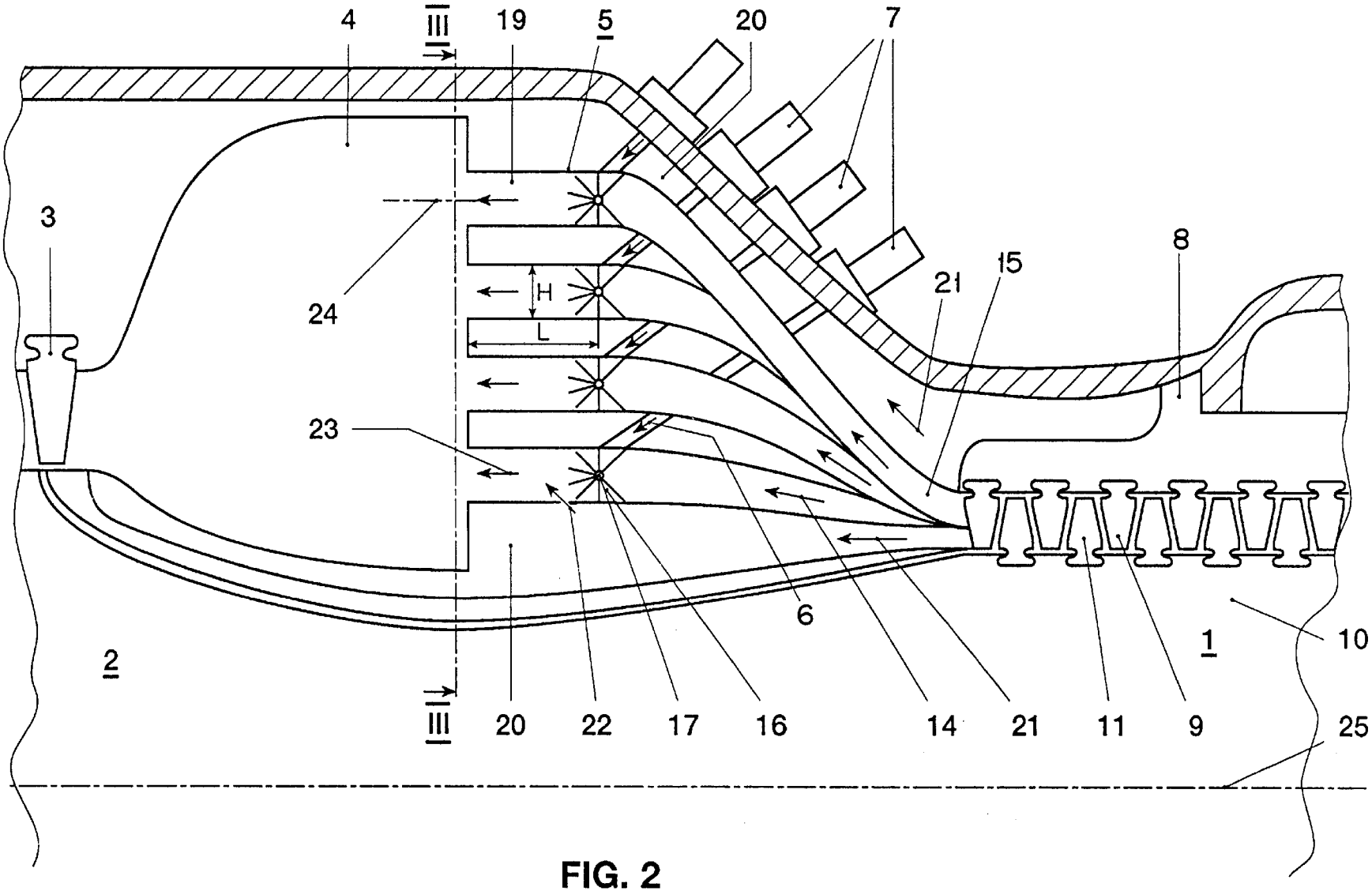
FIG. 2 shows a partial longitudinal section of a gas-turbine plant having a four-row annular combustion chamber according to the invention.

An exemplary embodiment of the invention is shown in FIG. 2 with reference to a four-row gas-turbine annular combustion chamber. Unlike the prior art described above, the air 14 is no longer decelerated to plenum conditions; on the contrary, the deceleration of the air 14 is restricted only to the velocity level of the premix section. The repeated deflection of the total air mass flow can thereby be dispensed with and the overall size in the region of the combustion chamber can be substantially reduced.

In the embodiment variant of the invention shown in FIG. 2, a burner air-distributor system is arranged directly downstream of the compressor outlet at the guide vanes 9 of the last compressor-blade row, in which burner air-distributor system in each case a combustion-air duct 15 designed as a diffuser leads to each burner 5 of the annular combustion chamber 4. At least one longitudinal-vortex generator 16 is located at the downstream end of the combustion-air duct 15. Provided in or downstream of the longitudinal-vortex generator 16 is at least one fuel injection means 17, and arranged downstream of the fuel injection means 17 is a mixing duct 19 which ends in the combustion chamber 4 and has a constant height H and a length L which corresponds approximately to twice the value of the hydraulic duct diameter D. The hydraulic duct diameter is defined as the ratio of four times the cross-sectional area of the duct to the duct periphery. Accordingly, in the case of a circular duct: H=D.

According to the invention, the deflection diffuser 12 and the plenum 13 are therefore dispensed with.

The air from the compressor 1 is apportioned directly after the discharge from the compressor 1 to a multiplicity of individual ducts, specifically to the combustion-air ducts 15 and to annular ducts 20 arranged on the hub side and casing side respectively for the cooling air 21 of the combustion chamber 4 and the turbine 2, which air is provided here at a high pressure level. In addition, air 22 can be extracted from the ducts 20 for flushing out the boundary layer forming in the mixing duct 19. This is shown as an example only for the innermost mixing duct 19.

The combustion-air ducts 15 are configured as diffusers and decelerate the air velocity to about half the value of the compressor outlet velocity, in the course of which a maximum of 75% of the dynamic energy can be converted into a pressure gain.

Figure 5:
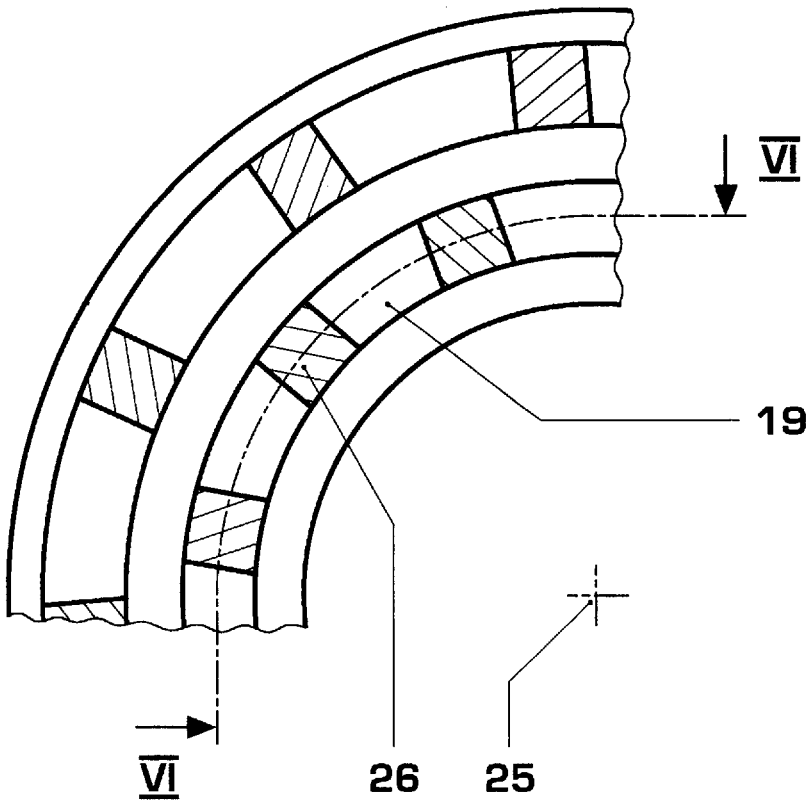
FIG. 5 is a sectioned view of a segmented annular gap for the mixing duct corresponding to the view of FIG. 3.
Figure 6:
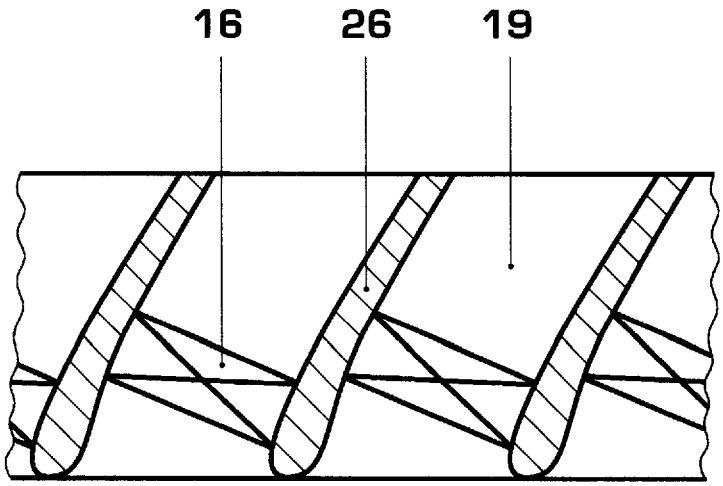
FIG. 6 is a sectioned view along the lines VI—VI in FIG. 5.

Once the combustion air 14 has been decelerated to a suitable velocity level, one or more longitudinal vortices per combustion-air duct 15 are generated at the longitudinal-vortex generator 16. In the longitudinal-vortex generator 16, fuel 6 which is fed, for example, through fuel lances 7 is admixed to the air 14 by an integrated fuel injection means 17. Of course, the fuel injection means 17 may also be arranged downstream of the longitudinal-vortex generators 16 in another exemplary embodiment. The generated longitudinal vortices ensure good mixing of fuel 6 and combustion air 14 in the adjoining mixing ducts 19. The latter have a constant height H and are approximately twice as long as two hydraulic duct diameters D. In the present case, the mixing ducts 19 have a circular cross section and are thus a mixing tube. Here, the mixing-tube axes 24 are arranged parallel to the axis 25 of the gas turbine. In other exemplary embodiments (not shown diagramatically here), the mixing ducts 19 may also have a rectangular or polygonal cross a segmented section. As illustrated in FIG. 5 and FIG. 6, the mixing ducts 19 may each be formed as annular gap. A plurality of bars 26 divide the annular duct into segments 19, and vortex generators 16 are mounted in each of the segments.

It is of advantage if the longitudinal vortices in the mixing duct 19 which are caused by the longitudinal-vortex generator 16 produce an overall swirl which leads after discharge of the fuel/air mixture 23 into the combustion chamber 4 to a highly turbulent flame-stabilization zone by the vortex breaking down and by a zone of very low or negative axial velocity being produced on the axis. Flashback of the flame into the mixing zone can be reliably prevented by a balanced axial velocity profile having a peak at the axis and by an additional injection of air 22 into the boundary layer of the mixing duct 19.

It is favorable if the number of guide vanes 9 of the last compressor row and the number of premix burners 5 are in an integral ratio to one another. A combustion-air duct 15 can thereby be coupled directly, for example, to one or two blade ducts of the last compressor row.

If FIGS. 1 and 2 are compared, the reduction in the area to be cooled of the combustion-chamber wall according to the invention can clearly be recognized. A gas turbine of the 170 MWel class, e.g. GT13E2, should serve as an example. Whereas the outside diameter in the region of the combustion chamber is about 4.5 m according to the prior art (FIG. 1), this value turns out to be only 3.5 m when the invention is used, so that a reduction in the overall size by about 20 is achieved. The cooling of the combustion chamber can be effected via film or effusion cooling due to the greatly reduced area to be cooled in the novel combustion chamber and due to the extremely low NOx emissions, obtainable with a good premix-burner technique, at relatively high flame temperatures (theoretically about 5 ppm NOx at 15% $O_2$ and 1850 K flame temperature).

Figure 3:
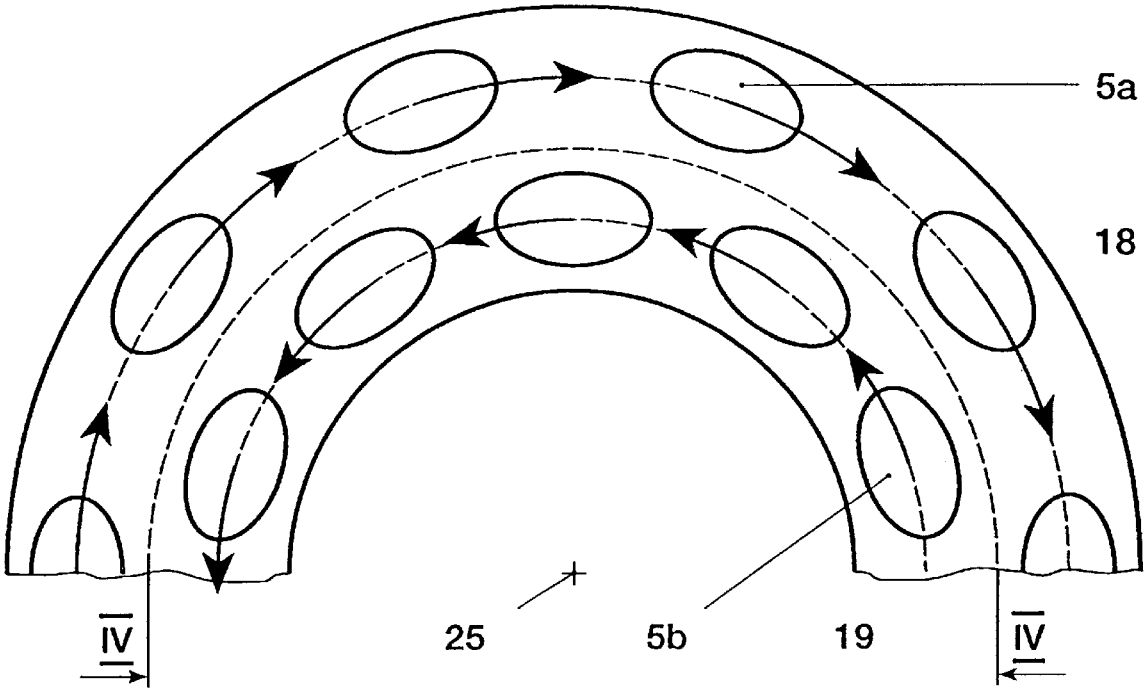
FIG. 3 shows a partial cross section of a two-row combustion chamber in accordance with a section in the plane III—III of the four-row annular combustion chamber shown in FIG. 2.
Figure 4:
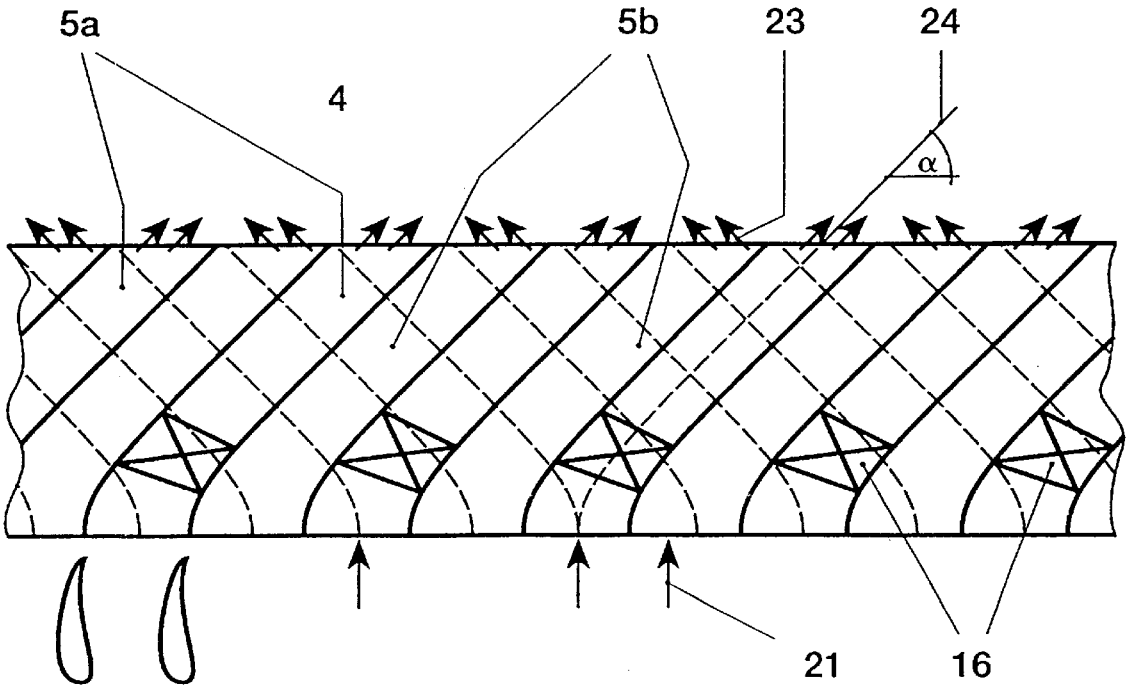
FIG. 4 shows a developed view of the premix section (along IV—IV in FIG. 3) between compressor outlet and combustion-chamber front plate.

FIGS. 3 and 4 show a further exemplary embodiment. FIG. 3 shows a partial cross section of a two-row annular combustion chamber in accordance with a section in the plane III—III of the four-row combustion chamber shown in FIG. 2. The annular combustion chamber 4 according to FIG. 3 is therefore equipped with two rows of premix burners 5. The arrows in FIG. 3 are intended to illustrate an opposed setting angle of the burners 5 in the rows lying side by side. This opposed setting angle ensures that no overall swirl is generated in the combustion chamber 4. In this exemplary embodiment, the cross section of the mixing ducts 19 is not round but elliptical.

FIG. 4 shows a developed view of the premix section between the compressor outlet and the combustion-chamber front plate 18 along IV—IV. The mixing-tube axes 24 are set in the peripheral direction relative to the shaft, i.e. the mixing-tube axis 24 forms an angle $\alpha$ of 45° with the machine axis 25. The mixing and flame stabilization in the combustion chamber 4 are thereby improved.

In a further exemplary embodiment (not shown), the combustion-air ducts 15 are arranged spirally around the axis 25 of the gas turbine in order to keep the axial length of the machine as small as possible.

The invention is especially suitable for the use of MBtu as fuel, that is fuel of average calorific value which results, for example, during the gasification of heavy oil, coal and tar. In this case, the fuel admixing can be shifted very simply into a region of higher velocity (>100 m/s) in order to reliably avoid flashback to the fuel injector in the case of these fuels too, which are characterized by a high flame velocity. The high-frequency (>1000 Hz) pressure pulsations (wakes of the blades) produced by the last compressor moving row especially assist the fuel/air mixing action here, since only a short deceleration section, i.e. a short combustion-air duct 15 designed as a diffuser, is required between the end of the compressor 1 and the fuel injection means 17.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A gas-turbine annular combustion chamber arranged downstream of a compressor comprising: a front plate with at least one row of premix burners arranged in an annular form, a plurality of combustion-air ducts, each combustion-air duct being designed as a diffuser and arranged to guide combustion-air directly downstream of a compressor outlet from guide vanes of a last compressor row to each premix burner, wherein at a downstream end of each combustion-air duct at least one longitudinal-vortex generator is disposed, at least one fuel injection means is disposed in or downstream of the longitudinal-vortex generator, and a mixing duct extending from the at least one fuel injection means to a combustion chamber, each mixing duct having a constant height (H) and a length (L) which corresponds approximately to twice the value of a hydraulic duct diameter (D) of the mixing duct.

2. The gas-turbine annular combustion chamber as claimed in claim 1, wherein a ratio of the number of guide vanes of the last compressor row to the number of premix burners is integral.

3. The gas-turbine annular combustion chamber as claimed in claim 2, wherein the ratio of the number of guide vanes of the last compressor row to the number of premix burners is one.

4. The gas-turbine annular combustion chamber as claimed in claim 2, wherein the ratio of the number of guide vanes of the last compressor row to the number of premix burners is two.

5. The gas-turbine annular combustion chamber as claimed in claim 1, wherein the plurality of combustion-air ducts is arranged spirally around a longitudinal axis of the gas turbine.

6. The gas-turbine annular combustion chamber as claimed in claim 1, wherein each mixing duct has a round cross section.

7. The gas-turbine annular combustion chamber as claimed in claim 1, wherein each mixing duct has a rectangular cross section.

8. The gas-turbine annular combustion chamber as claimed in claim 1, wherein each mixing duct is a segmented annular gap.

9. The gas-turbine annular combustion chamber as claimed in claim 1, wherein longitudinal axes of the mixing ducts and a longitudinal axis of the gas turbine are parallel.

10. The gas-turbine annular combustion chamber as claimed in claim 1, wherein longitudinal axes of the mixing ducts form an angle (a) with a longitudinal axis of the gas turbine.

11. The gas-turbine annular combustion chamber as claimed in claim 10, wherein the angle ($\alpha$) is about 45°.

12. The gas-turbine annular combustion chamber as claimed in claim 1 wherein, the combustion chamber has more than one annular premix-burner row, and wherein the premixing burners are set in an opposed manner from row to row in a peripheral direction.

13. A method of operating a gas-turbine annular combustion chamber having a front plate with at least one row of premix burner arranged in an annular form, a plurality of combustion-air ducts, each combustion-air duct being designed as a diffuser and arranged to guide combustion-air directly downstream of a compressor outlet from guide vanes of a last compressor row to each premix burner, wherein at a downstream end of each combustion-air duct at least one longitudinal-vortex generator is disposed, and at least one fuel injection means is disposed in or downstream of the at least one longitudinal-vortex generator, and having a mixing duct extending from the at least one fuel injection means to a combustion chamber, each mixing duct having a constant height (H) and a length (L) which corresponds approximately to twice the value of a hydraulic duct diameter (D) of the mixing duct, the method comprising the steps of: dividing the combustion air, directly after discharge from the compressor into individual air flows for the burners and for cooling of the combustion chamber and the turbine, decelerating a velocity of the air for the burners in the combustion-air ducts to about half the value of the compressor outlet velocity, generating at least one longitudinal vortex in the air per combustion-air duct, and injecting fuel during or downstream of the longitudinal-vortex generation forming a fuel/air mixture, the mixture flowing along in a mixing duct and flowing with an overall swirl imposed on it into the combustion chamber and being burnt there.

14. The method as claimed in claim 13, wherein air is additionally injected into a boundary layer of the mixing duct.

15. The method as claimed in claim 13, wherein, when fuel having an average calorific value (MBtu) is used, this fuel is intermixed in a region of high air velocity of greater than 100 m/s.

* * * * *